US006038907A

United States Patent [19]

Willems et al.

[11] Patent Number: 6,038,907

[45] Date of Patent: Mar. 21, 2000

[54] STRAIGHTENING MACHINE FOR ROLLED BEAMS

[75] Inventors: Markus Willems, Erkrath; Reinhold Thomas, Neuss, both of Germany

[73] Assignee: SMS Schloemann-Siemag Aktiengesellschaft, Düsseldorf, Germany

[21] Appl. No.: 09/301,054

[22] Filed: Apr. 28, 1999

[30] Foreign Application Priority Data

Apr. 29, 1998 [DE] Germany ..... 198 19 063

[51] Int. Cl.[7] ..... B21B 31/07; B21B 31/18

[52] U.S. Cl. ..... 72/247

[58] Field of Search ..... 72/247, 237, 249, 72/245

[56] References Cited

U.S. PATENT DOCUMENTS 5,152,164 10/1992 Horiuchi et al. ..... 72/247
5,154,074 10/1992 Haraguchi et al. ..... 72/247
5,806,361 7/1996 Kitamura et al. ..... 72/247

FOREIGN PATENT DOCUMENTS 0472765 3/1992 European Pat. Off. .

*Primary Examiner*—Rodney A Butler
*Attorney, Agent, or Firm*—Friedrich Kueffner

[57] ABSTRACT

A straightening machine for rolled beams, particularly I-beams, wherein at least one of the two straightening disks which rest from the inside against the beam flanges and are supported by a straightening shaft is axially adjustable. One of the straightening disks is fixedly connected to the straightening shaft through a mounting sleeve, while the other straightening disk is fixedly positioned in accordance with its adjusting dimension on a sliding sleeve which is adjustably mounted on the sleeve. Optionally, the mounting sleeve can be coupled to the sliding sleeve, on the one hand, and the sliding sleeve can separately be coupled to a piston/cylinder unit, on the other hand.

8 Claims, 2 Drawing Sheets

STRAIGHTENING MACHINE FOR ROLLED BEAMS

BACKGROUND OF THE INVENTION

1. Field of the Invention

The present invention relates to a straightening machine for rolled beams, particularly I-beams, wherein at least one of the two straightening disks which rest from the inside against the beam flanges and are supported by a straightening shaft is axially adjustable. One of the straightening disks is fixedly connected to the straightening shaft through a mounting sleeve, while the other straightening disk is fixedly positioned in accordance with its adjusting dimension on a sliding sleeve which is adjustably mounted on the sleeve, wherein it is also possible that several straightening disks, i.e., up to three straightening disks, are arranged on the sliding sleeve.

2. Description of the Related Art

A section straightening machine of this type, in which the outer dimensions of the straightening disks or the dimensions of the straightening disks between the flanges of the I-beam is adjustable by axially displacing one of the straightening disks, has been disclosed in EP-B1 0 472 765. In that case, the slidable straightening disk is arranged on a sleeve or sliding bushing which concentrically engages over the mounting sleeve or bushing. The mounting sleeve or bushing is connected through a wedge-type spring to the straightening shaft and another wedge-type spring provides the connection between the mounting sleeve and the outer sleeve or sliding bushing. The mounting bushing or sleeve is axially secured by a pressure sleeve which concentrically surrounds a journal end of the straightening shaft. A threaded sleeve with a thread integrally formed at its outer surface is rotatably arranged around this pressure sleeve. A ring screwed onto the external thread is connected to the sliding bushing or sleeve in order to prevent a rotation relative to a straightening machine frame, while converting the rotary movement into an axial displacement movement of the sliding sleeve as soon as the adjusting motor is put into operation. Aside from the resulting extremely complicated construction of this straightening disk adjustment, more or less great masses occur eccentrically in this straightening machine.

SUMMARY OF THE INVENTION

Therefore, it is the primary object of the present invention to provide a straightening machine of the above-described type which does not have the disadvantages mentioned above, and which particularly makes possible with a simple construction an axial adjustability and facilitates the assembly and disassembly.

In accordance with the present invention, optionally the mounting sleeve can be coupled to the sliding sleeve, on the one hand, and the sliding sleeve can separately be coupled to a piston/cylinder unit, on the other hand.

If it is only necessary to change the outer dimension of the straightening disks, i.e., the dimension between the straightening disks corresponding to the inside width of the beam, for example, when the rolling program is changed to beams with different flange thicknesses (hyper beams) or with different web heights, it is merely necessary to adjust the sliding sleeve with the straightening disk supported by the sliding sleeve on the mounting sleeve by means of the piston/cylinder unit. If the rolling program is changed to a completely different rolled section, for example, a I-section of another beam blank, the mounting sleeve is additionally coupled to the sliding sleeve connected to the piston/cylinder unit, preferably through at least one pin or the like, for example, a toggle or threaded toggle. This pin can be inserted or screwed into radial bores of the two sleeves which are in an aligned position. In that case, the entire unit can be pulled from the straightening shaft journal and can be replaced by a unit which has been prepared with adjusted straightening disks corresponding to the change in section in the rolling train.

To be able to precisely adjust the external dimension of the straightening disks, a measuring device may be placed on the outside of the two straightening disks. This measuring device can be equipped in such a way that, when the desired dimension is reached, a hydraulic valve is actuated which interrupts the movement as a result of an interruption of the supply of pressure medium to the piston/cylinder unit.

In accordance with a preferred embodiment of the invention, the sliding sleeve is fixedly connected to the straightening shaft through a clamping sleeve secured with its end facing away from the straightening shaft on the piston rod of the piston/cylinder unit and the sliding sleeve is axially adjustable by the piston/cylinder unit. The clamping sleeve which provides the connection between the piston/cylinder unit preferably arranged concentrically in the straightening shaft to the sliding sleeve can advantageously be connected for rotation with the straightening shaft by means of a friction element which can be radially expanded and released and which is arranged between the straightening shaft and the clamping sleeve on the straightening shaft journal. Such connecting couplings are commercially available and are composed of a hollow sleeve in whose interior a conical annular piston can be hydraulically displaced. The displacement of the conical annular piston produces a radial expansion, so that a play-free and frictionally engaging connection is produced between the clamping sleeve and the straightening shaft. After each assembly and disassembly, the oil is again discharged, so that no oil pressure exists in the radial expanding element during the operation.

In accordance with a proposal of the invention, a bayonet-type ring arranged on the shaft journal secures the mounting sleeve in its adjusted position of operation, wherein a counter-element is provided for the bayonet-type ring from the end of the shaft journal. The bayonet-type ring and the counter-element not only positionally secure the straightening disk unit which has been moved onto the straightening shaft, but the counter-element, preferably a threaded nut, arranged in front of the bayonet-type ring also absorbs axial forces if such axial forces act on the straightening disk arranged on the side of the machine. Any axial forces which act as a rule only from the outside on the straightening disks are absorbed during the straightening process, if such forces should occur from the outside by an incorrect positioning of the straightening disk, by the threaded nut in front of the bayonet-type ring.

In accordance with a preferred embodiment of the invention, a hydraulic nut with a mechanical counter-nut or counter-ring is arranged between a securing ring and the bayonet-type ring. This makes it possible to press the mounting sleeve over the bayonet-type ring onto the straightening shaft with a much greater force than would be possible if a mechanical counter-element were provided. Subsequently, the counter-element or the threaded nut serves to positionally secure the mounting sleeve which has been mounted, wherein the pressure of the hydraulic nut can then be released.

In accordance with an advantageous modification of the invention, a hydraulic unit is temporarily arranged in front of the counter-element which secures the adjustable straightening disk on the sliding sleeve. Consequently, for an easy positioning of the mechanical nut which acts during the straightening operation to counter the adjustment of the adjustable straightening disk and in order to achieve a conceptual equality with the hydraulically pretensioned bayonet-type ring, the hydraulic unit, which is only needed at the construction site, achieves a sufficient pretensioning of about 50 t, so that the counter-nut can be screwed onto the sliding sleeve. After pretensioning of the straightening disk unit, this hydraulic part or the clamping unit is once again removed, and the mechanical nut serves to secure the clamped position.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
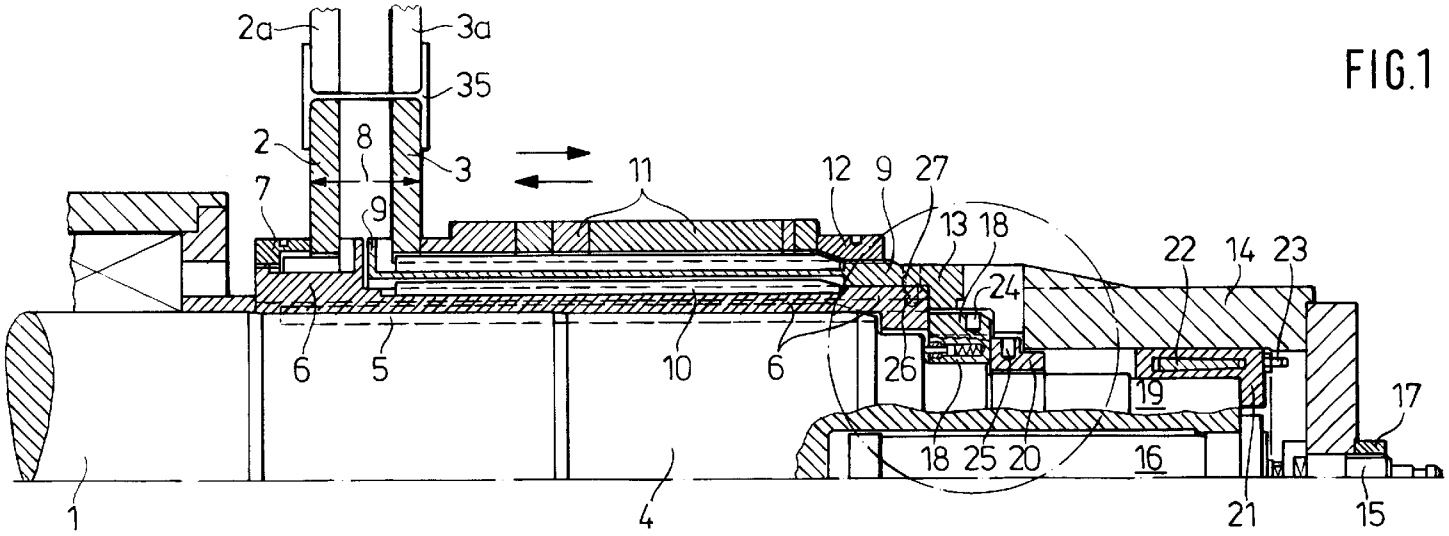
FIG. 1 is a partial sectional view of straightening disks with an adjusting unit arranged on a straightening shaft constituting a component of a roller straightening machine, not shown.

A straightening machine has upper and lower straightening shafts 1 with straightening disks 2, 3 mounted on the straightening shafts 1. Of this straightening machine, FIG. 1 of the drawing shows in a semisymmetrical sectional view the straightening journal 4 of the lower straightening shaft 1. Only schematically shown are the upper straightening disks 2*a*, 3*a* which interact with the lower straightening disks 2, 3 for straightening a hot-rolled I-beam 35. A mounting sleeve 6 is keyed through a tongue 5 on the straightening journal 4 of the straightening shaft 1, wherein the rear straightening disk 2 is secured on the mounting sleeve 6 by means of a mechanical nut 7.

The front straightening disk 3, i.e., the straightening disk on the right as seen in FIG. 1, is constructed so as to be movable or adjustable in the direction of the two arrows, so that it is possible to change the inside width 8, i.e., the distance between the two inner surfaces of the I-beam 35, for example, when rolling beams with a different flange thickness or a different web height. For moving the straightening disks 2, 3 apart from each other or toward each other, a sliding sleeve 9 supporting the straightening disk 3 is arranged on a guide key 10 of the mounting sleeve 6. The straightening disk 3 rests against shims 11 against which the straightening disk 3 is clamped by means of a mechanical nut 12 which is screwed from the free end of the sliding sleeve 9 onto the sliding sleeve 9. The sliding sleeve 9 is connected through a schematically illustrated threaded connection 13 to a clamping sleeve 14 which rests on its end on the side of the straightening shaft journal on the piston rod or piston rod head 15 of a piston/cylinder unit 16 which is arranged concentrically in the straightening journal 4 and the clamping sleeve 14 is secured on the piston/cylinder unit 16 by means of a counter-nut 17.

Used for axially clamping the mounting sleeve 6 on the straightening journal 4 is a bayonet-type ring 18 which is mounted so as to rest against the free end face of the mounting sleeve 6, wherein the position of the bayonet-ring 18 is countered by a nut 20 screwed onto a journal portion 19 of the straightening journal 4. A hydraulically radially expandable and releasable expansion element 21 is arranged between the journal portion 19 of the straightening journal 4 and the clamping sleeve 14, wherein, for displacing a conical annular piston 22 received in the interior of the expansion element 21, the expansion element 21 is connected through a hydraulic connection 23 to a pressure medium source, i.e., a hydraulic pump. The radial expansion produced by displacing the annular piston 22 results in a play-free and frictionally engaging connection between the journal portion 19 and the clamping sleeve 14 which, as a result, is secured on the straightening journal 4.

If the inside width 8 is to be increased, the adjustable straightening disk 3 must be moved on the mounting sleeve 6 on the guide key 10 in the direction of the arrow pointing toward the right as seen in FIG. 1. For this purpose, after the operation of the straightening machine has been stopped, it is merely necessary to connect the expansion element 21 through the hydraulic connection 23 to the hydraulic unit, not shown, and to eliminate the frictional engagement between the clamping sleeve 14 and the straightening journal 4. The piston/cylinder unit 16 to which pressurized oil is subsequently admitted then adjusts the sliding sleeve 9 which is screwed to the clamping sleeve 14 and the straightening disk 3 supported by the sliding sleeve 9 into the desired new position which is monitored by a measuring device. As soon as the radial expansion element 21 has once again produced the frictional engagement between the journal portion 19 of the straightening shaft 1 and the clamping sleeve 14, the adjusted position of the straightening disk 3 is secured by the expansion element 21. Moreover, if necessary for certain applications, the maximum adjusting range for the straightening disk 3 can be varied in a simple manner by varying the length of the straightening journal 4 and the clamping sleeve 14 from the outset.

Figure 2:
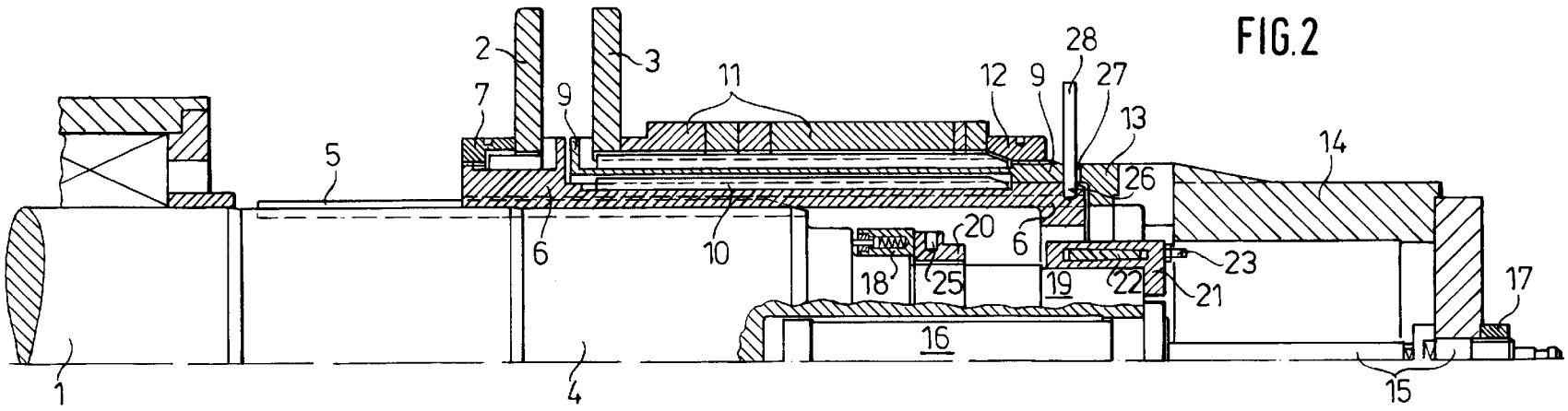
FIG. 2 is a partial sectional view of the straightening disk unit of FIG. 1 shown during the disassembly of the straightening disks from the straightening shafts.

The disassembly of the straightening disk unit is illustrated in FIG. 2. It is also in this case necessary to bring the radial expansion element 21 initially into its pressureless initial position, i.e. to move the inner key or the conical annular piston 22 into its releasing position, so that no radial spreading or expansion forces are present. It is then possible to initially unscrew the counter-nut 20 which for inserting a round bar has a receiving opening 25; subsequently, the bayonet-type ring 18 can be mechanically loosened by means of a round bar to be inserted from the outside into a receiving bore 24, i.e., the bayonet-type ring 18 is turned by 45° from the position shown in FIG. 1 into the position shown in FIG. 2. In the illustrated embodiment, a pin 28, shown in FIG. 2, is inserted into bores 26 and 27 of the mounting sleeve 6 and the sliding sleeve 9, respectively, which are in alignment with each other; in order to achieve the aligned position of the bores, the sliding sleeve 9 must be moved into the initial or zero position illustrated in FIG. 1. The pin 28 produces the necessary connection between the mounting sleeve 6 and the sliding sleeve 9 which is necessary for the common movement thereof. By connecting the piston/cylinder unit 16 to a pressure medium source, the piston rod 15 is then moved into the disassembly position illustrated in FIG. 2 and pulls the entire unit guided on the key 5 of the straightening journal 4 from the straightening shaft 1. Accordingly, the piston/cylinder unit 16 serves two functions, i.e., the positioning of the sliding sleeve 9 alone for the adjustment of the internal width, on the one hand, and the pulling of the entire structural unit from the straightening shaft 1 as just described, on the other hand. The piston/cylinder unit 16 can move at two speeds which are controlled by a proportional valve and each assigned to the respective function.

Figure 3:
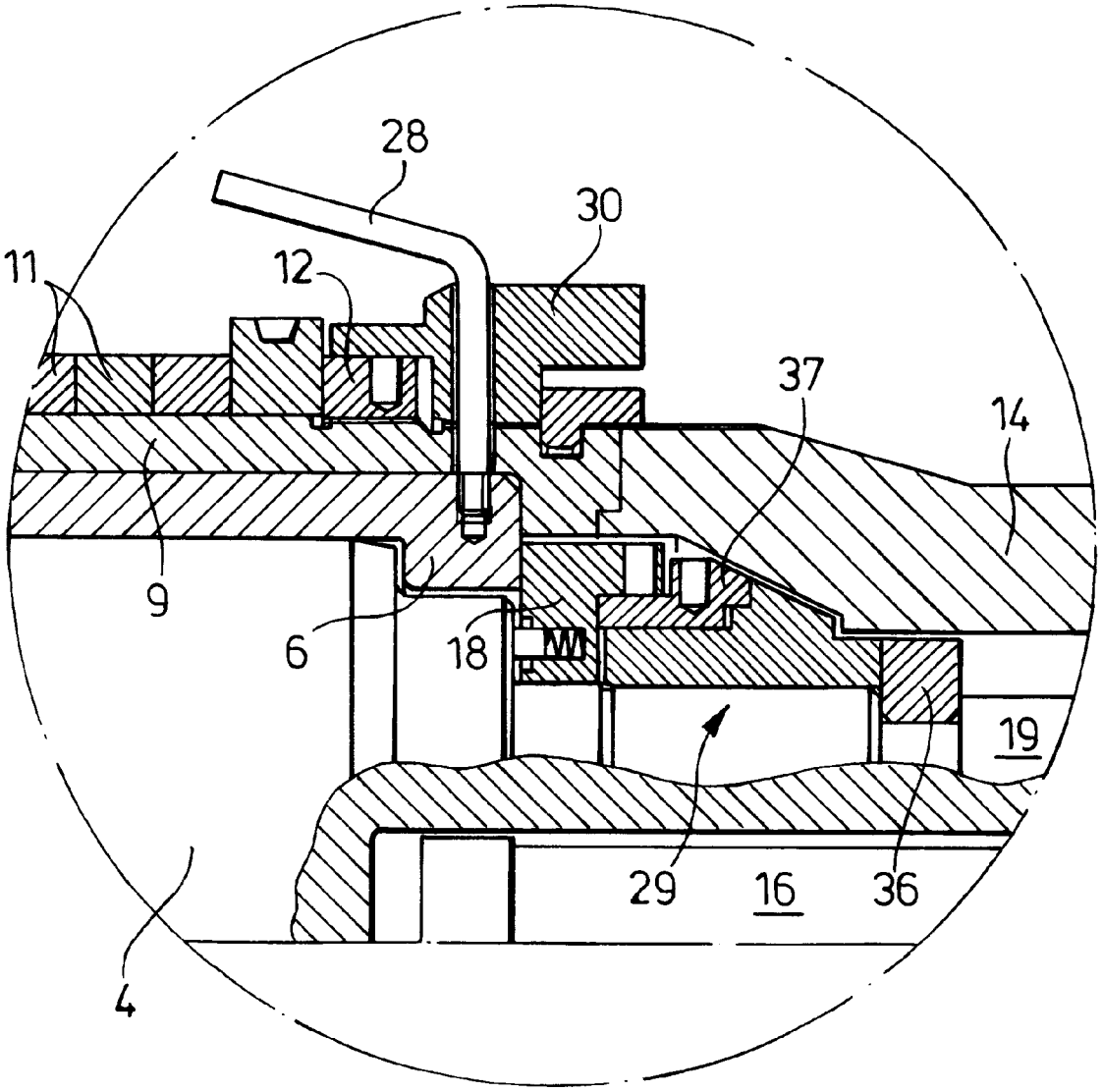
FIG. 3 is a sectional view, on a larger scale, showing a detail of FIG. 1 identified by a circle in dash-dot lines.

In the alternative embodiment shown in FIG. 3 of the structural components shown in FIG. 1 in a dash-dot circle, a hydraulic nut 19 is provided between the bayonet-type ring 18 which acts axially on the mounting sleeve 6 and a securing ring 36, wherein the hydraulic nut 29 makes it possible to clamp the mounting sleeve 6 with a greater force on the straightening shaft 1 or the straightening journal 4, wherein, as soon as the pressure of the hydraulic nut has been eliminated, a counter-nut 37 comparable to the above-described counter-nut 20 then secures the mounting sleeve 6 which has been slid on. FIG. 3 additionally shows a hydraulic unit 30 mounted on the clamping sleeve 14; however, this hydraulic unit 30 is only needed at the construction site for preassembling the straightening disk unit in order to be able to apply a greater force for pretensioning the straightening disks 2, 3. After the preassembly of the straightening disk unit, this hydraulic unit 30 is then once again removed and, as also shown in FIGS. 1 and 2, the mechanical counter-nut 12 secures the position of the straightening disks adjusted by the shims 11.

While specific embodiments of the invention have been shown and described in detail to illustrate the inventive principles, it will be understood that the invention may be embodied otherwise without departing from such principles.

We claim:

1. A straightening machine for rolled I-beams having beam flanges, the straightening machine comprising a straightening shaft and a mounting sleeve mounted on the straightening shaft, a first straightening disk fixedly mounted on the mounting sleeve, a sliding sleeve adjustably mounted on the mounting sleeve, and a second adjustable straightening disk mounted on the sliding sleeve, wherein the straightening disks are configured to rest against inner surfaces of the beam flanges, and wherein the second straightening disk is secured with respect to an adjusting dimension by a counter-positioning means, further comprising coupling means for coupling the mounting sleeve to the sliding sleeve and separate coupling means for coupling the sliding sleeve to a piston/cylinder unit.

2. The straightening machine according to claim 1, wherein the piston/cylinder unit comprises a piston rod, a clamping sleeve mounted on the piston rod with an end thereof facing a straightening shaft journal, wherein the sliding sleeve is connected for rotation through the clamping sleeve to the straightening shaft, and wherein the sliding sleeve is axially adjustable by the piston/cylinder unit.

3. The straightening machine according to claim 1, wherein the piston/cylinder unit is mounted concentrically in the straightening shaft.

4. The straightening machine according to claim 1, wherein the coupling means between the mounting sleeve and the sliding sleeve is comprised of at least one pin.

5. The straightening machine according to claim 1, further comprising a bayonet-type ring mounted on the straightening shaft journal for securing the mounting sleeve in an adjusted position of operation thereof, wherein a positioning counter-means acts on the bayonet-type ring from an end of the straightening shaft journal.

6. The straightening machine according to claim 5, wherein the positioning counter-means is comprised of a nut configured to be screwed onto a straightening shaft portion.

7. The straightening machine according to claim 5, further comprising a hydraulic nut with a mechanical counter-nut mounted on a shaft journal portion between a securing ring and the bayonet-type ring.

8. The straightening machine according to claim 5, wherein the positioning-counter means for securing the adjustable straightening disk on the sliding sleeve temporarily comprises a hydraulic unit acting on the positioning-counter means.

* * * * *